US007431175B2

(12) United States Patent
Heilos

(10) Patent No.: US 7,431,175 B2
(45) Date of Patent: Oct. 7, 2008

(54) DRINKING CUP LID FOR ASSISTING IN INGESTION OF MEDICATION

(76) Inventor: Roger Heilos, 169 Nimitz St., Bridgewater, NJ (US) 08807

( * ) Notice: Subject to any disclaimer, the term of this patent is extended or adjusted under 35 U.S.C. 154(b) by 135 days.

(21) Appl. No.: 10/892,792

(22) Filed: Jul. 16, 2004

(65) Prior Publication Data

US 2006/0011639 A1 Jan. 19, 2006

(51) Int. Cl.
*A47G 19/22* (2006.01)
*B65D 83/00* (2006.01)
*A61J 7/00* (2006.01)

(52) U.S. Cl. ..... 220/717; 215/389; 604/78

(58) Field of Classification Search ..... 220/730, 220/717, 716, 711, 713, 714, 705, 703; D7/509–511, D7/392.1; 222/570, 566, 567; 215/386–388; 604/78

See application file for complete search history.

(56) References Cited

U.S. PATENT DOCUMENTS 442,698 A 12/1890 Yates
2,919,694 A 1/1960 Von Gunten
2,940,447 A 6/1960 Zanegood
3,302,644 A * 2/1967 Kennedy et al. ..... 604/78
3,302,664 A 2/1967 Plamann
3,810,470 A * 5/1974 Von Gunten ..... 604/78
4,135,512 A 1/1979 Godsey
D259,231 S 5/1981 Zozlow, Sr.
4,581,013 A * 4/1986 Allen ..... 604/78
4,961,510 A * 10/1990 Dvoracek ..... 220/713
4,981,468 A * 1/1991 Benefiel et al. ..... 604/83
5,871,118 A * 2/1999 Franzese ..... 220/717

* cited by examiner

*Primary Examiner*—Robin Hylton
(74) *Attorney, Agent, or Firm*—Baker & Rannells, PA

(57) ABSTRACT

An improved drinking cup lid for assisting in the ingestion of medication and other materials in the form of pills, tablets or capsules, which is used in combination with a cup holding liquid to be taken with the medication or pills/tablets, contains a spout with a base grid. Both the spout and the base grid have pointed ribbed members which minimize the points and area of contact between the pill or tablet and the dispensing device. The spout is tilted approximately 30 to 35 degrees from the vertical toward the center of the cup such that when the medication or pill to be ingested, the liquid first passes through the grid in the bottom of the spout, the pill is thoroughly wetted, and is washed with the liquid through the angled spout into the mouth of the user.

6 Claims, 11 Drawing Sheets

SECTION A-A

SECTION B-B 101
111
011
D
D
203
203
203
203
203
VIEW C

SECTION D-D

DRINKING CUP LID FOR ASSISTING IN INGESTION OF MEDICATION

This invention relates generally to devices to assist individuals in swallowing "pills" including medications, dietary supplements, vitamins and the like. It is especially useful for assisting the infirm and children.

BACKGROUND OF THE INVENTION

There are various reasons why different groups of people have difficulty swallowing pills, including capsules, tablets, and the like. Some individuals, like very young children and the elderly suffering from dementia or other conditions affecting their cognitive abilities are one group. Other groups are individuals who have difficulty swallowing due to conditions such as Parkinson's disease and other conditions which interfere with their ability to swallow. There are also people who suffer from fear of choking or gagging which in sensitive people is often initiated when they place a dry pill, tablet, or capsule in their mouth. In addition to the foregoing categories, there are many people who have no specific impediments but find that swallowing pills an unpleasant experience due to with the taste of the pill to be swallowed or difficulty in swallowing because of size or because the pill tends to stick in the mouth.

The process of developing this product included testing many different types of pills and capsules. It was found that as soon as any liquid comes into contact with a wide variety of pills and capsules, the pills and capsules immediately stuck to the dispensing devise. This sticking occurred with both hard water and soft water and was more extreme and was more difficult to dislodge when using hard water. Often times the flow of water through the dispensing device was insufficient to dislodge the pill or capsule, thus preventing the device from assisting in swallowing the pill or capsule. Pills and capsules presently in use range in size from the smallest, which is approximately a quarter of an inch in diameter and as thin as fifty-thousands of an inch, to tablets and capsules as large as one and one-eighth inches long and this invention is designed to accommodate all of these sizes.

BRIEF DESCRIPTION OF PRIOR ART

There have been numerous attempts at addressing this problem over the years, some of which are described in the prior art. For instance, in U.S. design Pat. 259,231 issued to William Kozlow, a drinking cup lid for dispensing solid medication incorporating a spout with a perforated base is disclosed. There is a detachable cup and lid with straight sidewall on the mouthpiece. There is no taper to create a water reservoir and the pill will enter the mouth dry. Since there is no back taper on the spout, the pill may fall out before making contact with the mouth. U.S. Pat. No. 3,302,664 issued to Kennedy, et al, discloses an oral medicine administering device for children which incorporates a spout that includes a projectable and retractable slide unit in the medicine holding tray. This is a device designed to "trick" the user. The device has a compartment to hide the pill which slides forward to mix the pill and water. This device requires a person to operate the pill tray so that the recipient of the pill is not in control of the slide which moves the pill tray forward to dispense the pill. U.S. Pat. No. 2,919,694 issued to Von Gunten, shows a series of ribs molded or attached internally inside the cup which supports a pill. The ribs form a series of water channels up the side of the vessel with a pill holder on the top. The user places a pill in the holder and the water is intended to flow through the channels and push the pill out. This invention is similar to Koslow, but instead of having the pill held in the top and falling out when the cup is tipped, the ribs replace the perforated cap. It has similar limitations as described in Koslow above. U.S. Pat. No. 4,135,512 issued to Godsey, shows a medication dispensing cup that describes a hinged lid containing a grate on which the pill is placed prior to use of the dispensing cup. This is a nestable, disposable device made of material which is unspecified in the patent. The device has a flexible fold-down lid with a grate for water to pass through. The pill would immediately stick to the surface of the mouthpiece when wet. U.S. Pat. No. 442,698 issued to Yates, describes a device for facilitating taking pills which also describes a grate-type structure to hold a pill prior to taking the pill. To use this device users must place their mouth directly over the grate and drink or the user will miss the pill. U.S. Pat. No. 2,940,447 issued to Zanegood, describes a drinking glass for swallowing pills and the like with a series of wedge-shaped perforations in a support which holds the pill and directs the flow of liquid from the cup. This device is essentially the same idea as the Yates patent described above with a metal pill holder with a flexible snap ring that sits inside a water glass. Water passes through the holder and pushes a pill into the mouth. While all of these various inventions provide some facilitation in the taking of pills, all have certain limitations and drawbacks which are overcome by the present invention. For example, all of these devices have substantial areas of contact between the pills and the device. These areas of contact, when the liquid contacts the pill, frequently result in the pill adhering to the device and not readily allowing the pill to dislodge and flow freely with the liquid into the mouth of the recipient. If a reduced amount of liquid is used to avoid wetting of the pill these configurations, which all tend to have a more or less direct path of travel from the centerline of the device for the line of travel of the pill and liquid, the pill will move into the mouth of the recipient before a substantial amount of liquid has flown through the outlet of the dispensing device into the mouth of the recipient. This effect reduces and in some cases eliminates the effectiveness of having the pill washed into the mouth with a significant amount of liquid to facilitate swallowing. In addition, in many of these configurations the side walls of the path along which the pill must travel from the device into the mouth of the recipient are generally flat surfaces which provided a substantial area for adhesion of the pill to the side wall of the dispensing device. The within invention overcomes all of these limitations and disadvantages.

OBJECTS OF THE INVENTION

It is an object of the present invention to provide an improved drinking cup lid to assist in swallowing pills and capsules that holds a pill above liquid and uses the liquid flow to carry the pill or capsule into the mouth where the liquid and the pill are swallowed together.

It is also an object of the present invention to provide a device designed to be used by children as well as infirmed adults with simple "afraid to swallow syndrome" or those with mild disabilities due to stroke, neck injury and back injuries who cannot tilt their heads backwards or bedridden individuals and individuals in rehabilitation programs to assist in swallowing medication and other pills or capsules.

It is a further object of the present invention to get a dry pill into the mouth and swallowed without the person realizing that they have done so.

It is an additional object of the present invention, when used in combination with a typical liquid dispensing cup, for example a cup holding approximately four (4) fluid ounces of water or juice, said invention incorporating a mouthpiece that has a 30-35 degree back-slant in which the liquid and pill mix in the mouthpiece, avoiding the tendency of the pill to fall out as the cup is raised, and which require less backward head tilting for the liquid and pill to flow into the mouth. This feature is especially useful for persons with dysphasia (throat closing) and neck and or back problems.

It in an additional object of the present invention to provide a drinking cup lid with an extended mouthpiece to provide nose clearance for the user.

It is also an object of the present invention to hold a pill above the liquid level on a grill that allows the liquid to pass through and carry the pill with it into the mouth.

It is an additional object of this invention to provide ribs in the grill of uneven height to minimize surface contact points with the pill and help diffuse the liquid surface tension to minimize the tendency of a pill to stick to the device.

It is also an object of this invention to provide a spout with vertical ribs in the sides of the spout to minimize contact points with the pill resulting in all surfaces that a pill comes in contact with contain ribs.

It is an additional object of the present invention to have all ribs in the spout to terminate in a pointed configuration to further minimize the contact area between the spout and the pill.

It is an object of the present invention to provide an improved drinking cup lid for assisting in the ingestion of medication that holds the pill above the liquid in the cup and uses the liquid flow to carry the pill/tablet into the mouth where the liquid and pill are swallowed together.

It is an additional object of the present invention to provide for a device to assist young children in the swallowing of pills and tablets.

It is also an object of the present invention to provide an improved device to assist infirm adults with a device to facilitate the taking of pills and tablets.

It is a further object of the present invention to facilitate the taking of medicine by individuals who have "an afraid to swallow syndrome" as well as those with mild disabilities due to stroke, neck injury or back injuries which restrict an individual's ability to tilt his head back as well as for people who are bedridden and have difficulty in tilting their head back sufficiently to assist in drinking from a normal cup.

It is a further object of the present invention to provide a device which minimizes surface tension effects which tend to cause pills and capsules to stick to a medication or pill dispensing device.

It is an additional object of the present invention to provide for a device that is capable of dispensing the full range of sizes of pills and capsules.

It is also an object of the present invention to provide a device that has an opening of a convenient size for fully inserting into the mouth of the user to assist in taking medication.

It is also an additional object of the present invention to provide a spout that is tilted to facilitate combining liquid with the medication and thereby facilitate swallowing such medications.

It is also an object of the present invention to provide a device for the dispensing of medication with ridged or ribbed supports terminating in points to minimize the area of contact between pills or tablets and the device.

It is a further object of the present invention to provide for a device that reduces the possibility that a pill or capsule to be taken will roll out of the device before the mouthpiece is inserted into the user's mouth for taking the medication.

It is also an object of the present invention to provide for a device that has closely spaced but pointed members to support the pill or tablet before the use with different heights to minimize the contact points between the pill/capsule and the device to facilitate dispensing of the said pill or capsule.

It is also an object of the present invention to provide a pill/capsule dispensing device in which no flat surfaces contact the pill/capsule.

It is also an object of the present invention to provide a device that can be used with standard cups of various materials including paper, plastic, etc.

In addition the present invention can be used in combination with a liquid dispensing cup made specifically for the cup lid or can be made to utilize existing cups in standard sizes which are now available or which may become available in the future.

It is also an object of the present invention to provide a cup lid which is reusable.

It is an additional object of the present invention to provide a cup lid which is inexpensive and suitable for a single use.

SUMMARY OF THE INVENTION

The present invention addresses several limitations and disadvantages described in the prior art and incorporates improvements including the use of ribbed members, which in the preferred embodiment are pointed, in the portion of the dispensing device which holds the pill/capsule in both the bottom section as well as along the sidewalls of the mouthpiece to reduce the contact area between the pill or capsule and the device to avoid sticking when the liquid contacts the pill/capsule. In addition the spout, instead of being perpendicular to the top surface of the cap as illustrated in the prior art, is tipped in the preferred embodiment approximately thirty to thirty five degrees from the vertical toward the center of the dispensing cup. This tilting accomplishes both a thorough wetting of the pill/tablet before the tablet travels through the spout into the user's mouth and reduces the angle at which the user's head has to tilt back in order to cause the liquid and the pill/tablet to flow from the device into the mouth of the user. The reduction in tilting of the users head is approximately equal to two the angle which the spout is rotated from the vertical axis.

In addition the present invention can be used in combination with a liquid dispensing cup made specifically for the cap/spout combination or can be made to utilize existing cups in standard sizes currently manufactured for such use.

In the preferred embodiment the spout cross section is approximately one and one-eighth inches wide across the long dimension and three quarters of an inch across the short dimension and approximately one and one-quarter inches long.

In the preferred embodiment the base has a grid which is comprised of alternating high and low pointed ribs which are spaced at approximately 0.040 inches apart and are approximately 0.040 inches wide such that the smallest tablet will not fall through the grid into the liquid. The height of the ribs in the base grid are approximately 0.040 inches for the low ribs and approximately 0.070 inches for the high ribs. There are pointed ribs along the sides of the spout and in the preferred embodiment the ribs on the long sides, i.e. the front and rear portions of the spout, are approximately 0.070 inches in height with pointed tops and the ribs around the short sides are approximately 0.0252-0.030 inches in height with pointed tops. The side ribs on the short sides are spaced at approximately ten degrees apart along the curve of the sides and the ribs on front to back of the spout are aligned with the ribs in the bottom grid. The dispensing cap is designed to slip over and snap onto the rim of a dispensing cup. Ribs of varying thickness, spacing and heights with rounded tops as well as flat tops or other cross sections are contemplated by this invention.

DETAILED DESCRIPTION OF THE DRAWINGS

Figure 1:
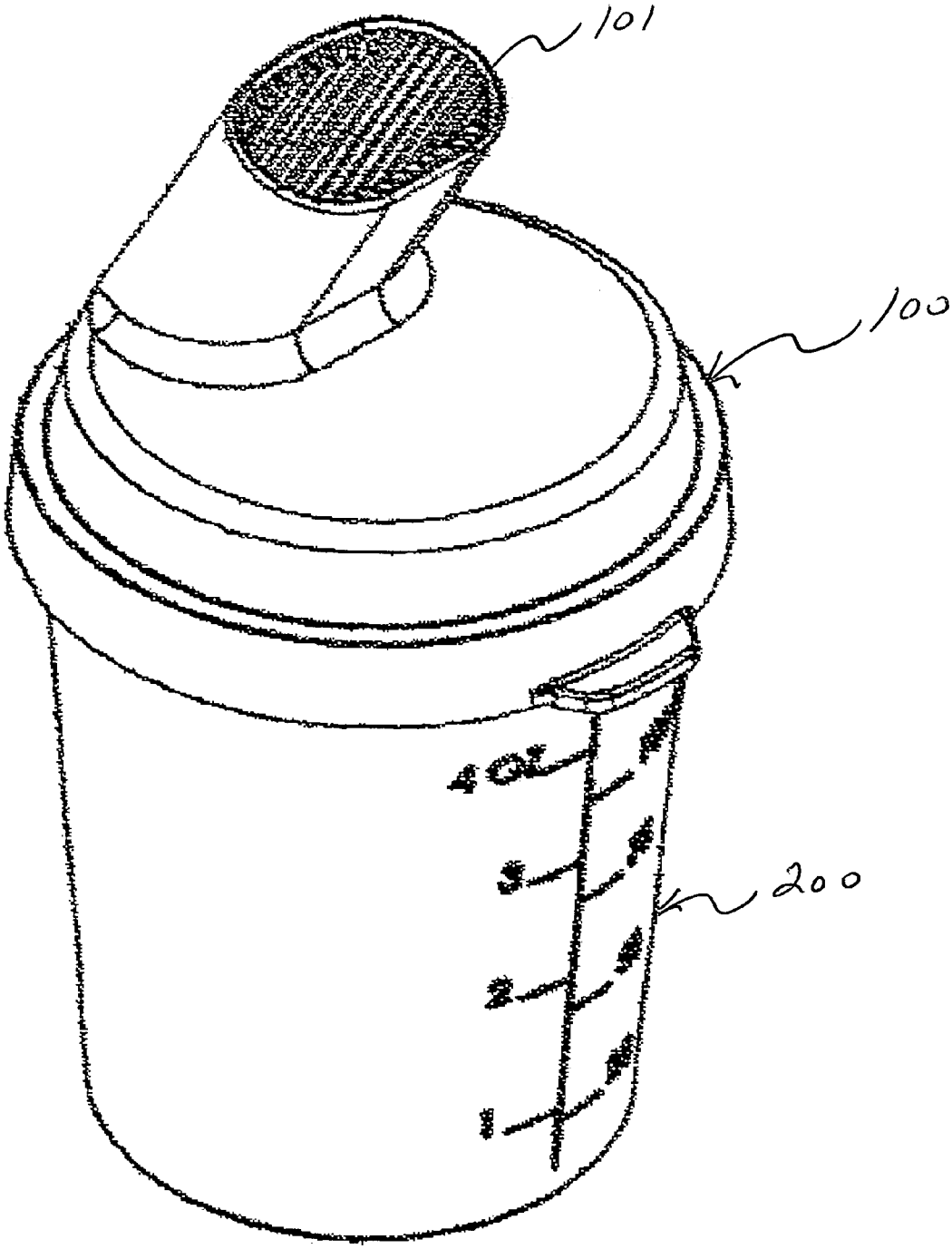
FIG. 1 is an isometric view of the improved drinking cup lid shown in combination with a dispensing cup.

FIG. 1 shows drinking cup lid 100 used in combination with cup 200, illustrating spout 101.

Figure 2:
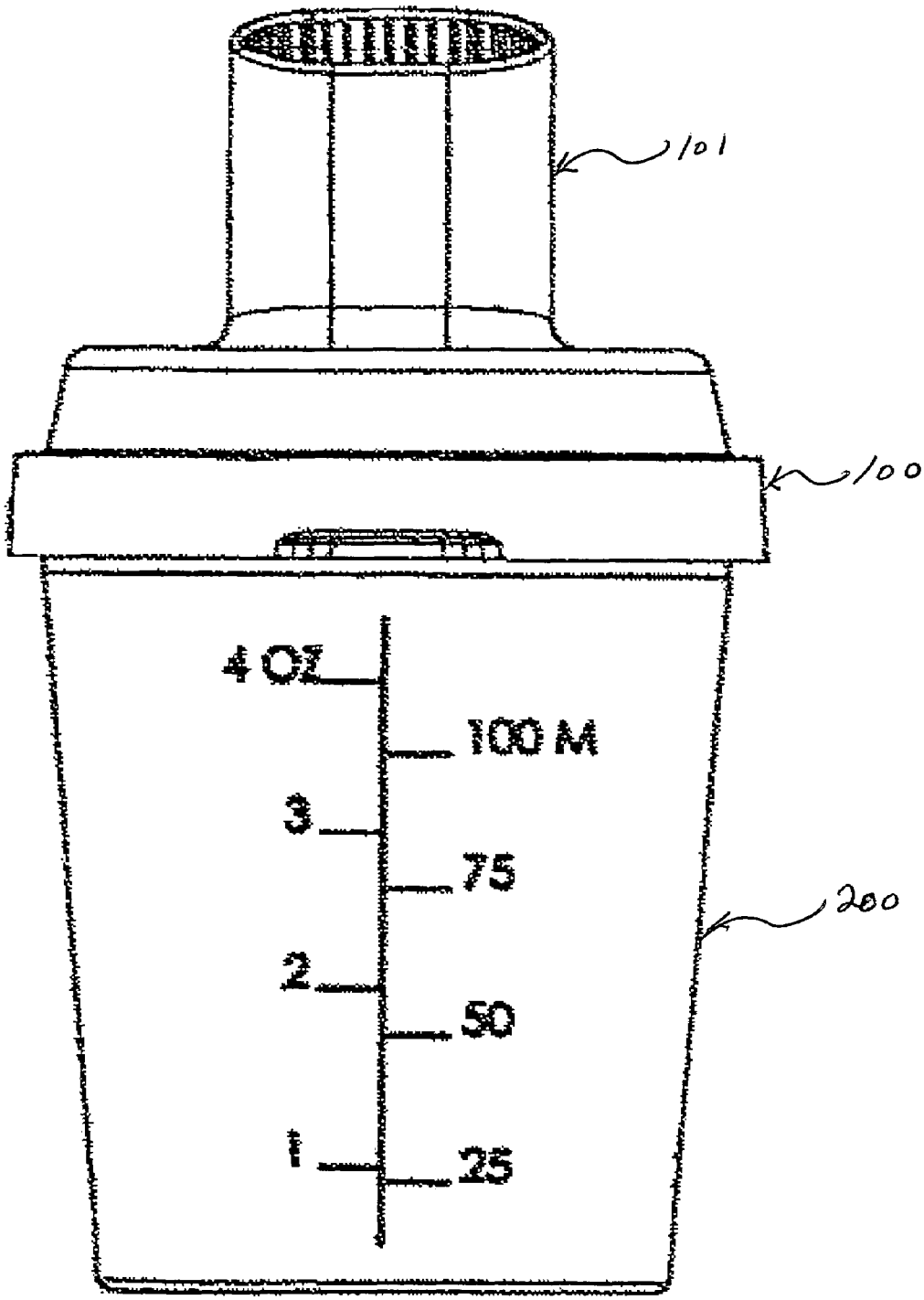
FIG. 2 is an elevation view of the improved drinking cup lid shown in combination with a dispensing cup.

FIG. 2 is an elevation view of drinking cup lid 100 used in combination with cup 200, illustrating spout 101 in elevation view.

Figure 3:
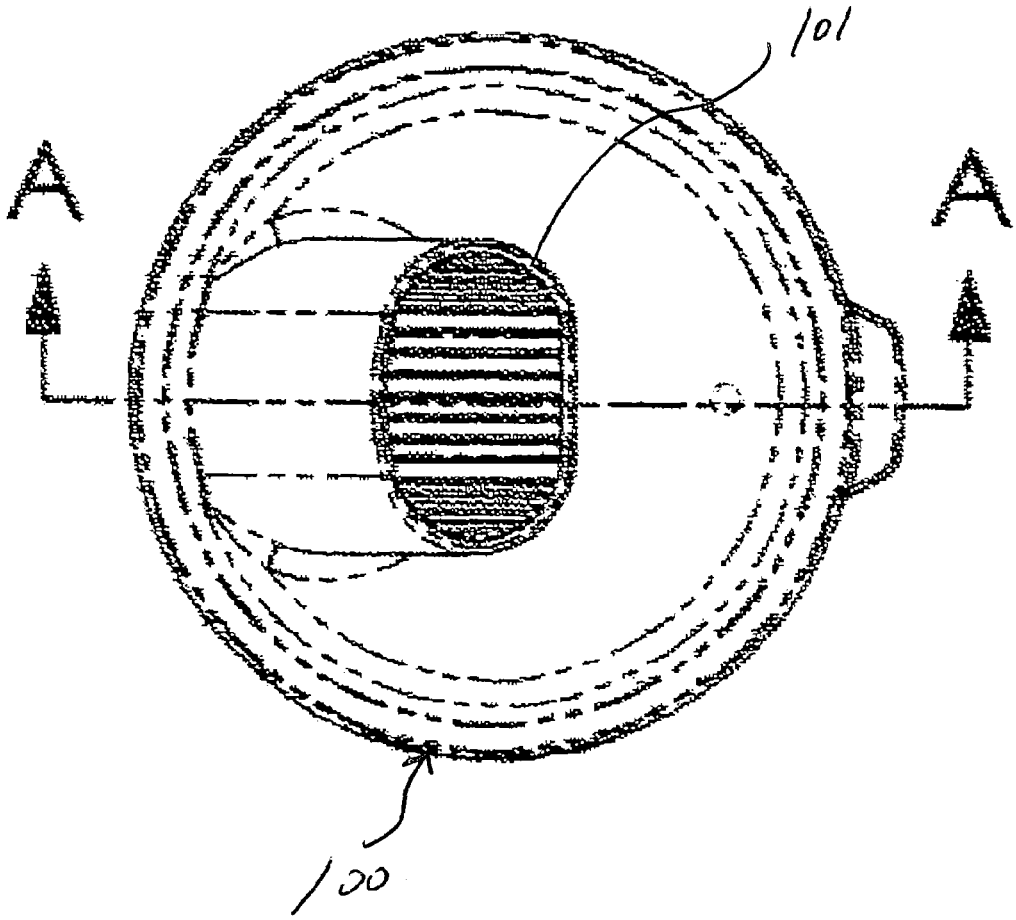
FIG. 3 is a plan view of the improved drinking cup lid.

FIG. 3 is a plan view of drinking cup lid 100 showing spout 101 as configured in the preferred embodiment. The spout is configured as a hollow tube having a cross section that is substantially oval in shape.

Figure 4:
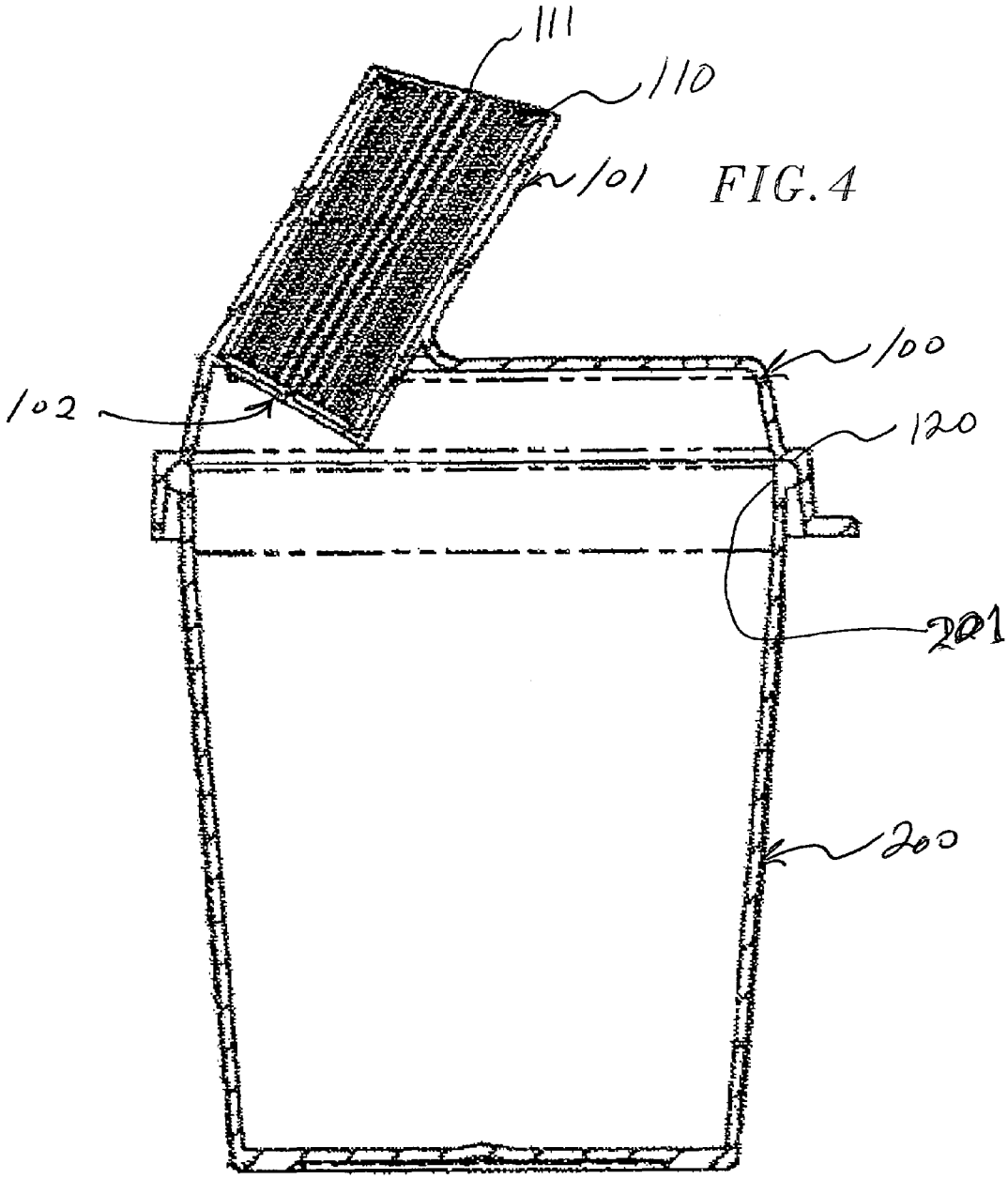
FIG. 4 is a section of the improved drinking cup lid in combination with a dispensing cup through section AA.

FIG. 4 is a cross-section as set forth as AA in FIG. 3 of cup lid 100 used in combination with cup 200 showing a cross-section through spout 101, illustrating base grid 102, long side ribs 110, short side ribs 111, drinking cup lid shoulder 120, and cup rim 201 which illustrates the cooperation between drinking cup shoulder 120 and cup rim 201, whereby drinking cup lid 100 is inserted over cup 200 so that when cup rim 201 is inserted into drinking cup lid 100 and rests against shoulder 120 forms a seal to hold liquid in the combination of drinking cup lid 100 and cup 200 when the cup is tilted, so that liquid goes through spout 101.

Figure 5:
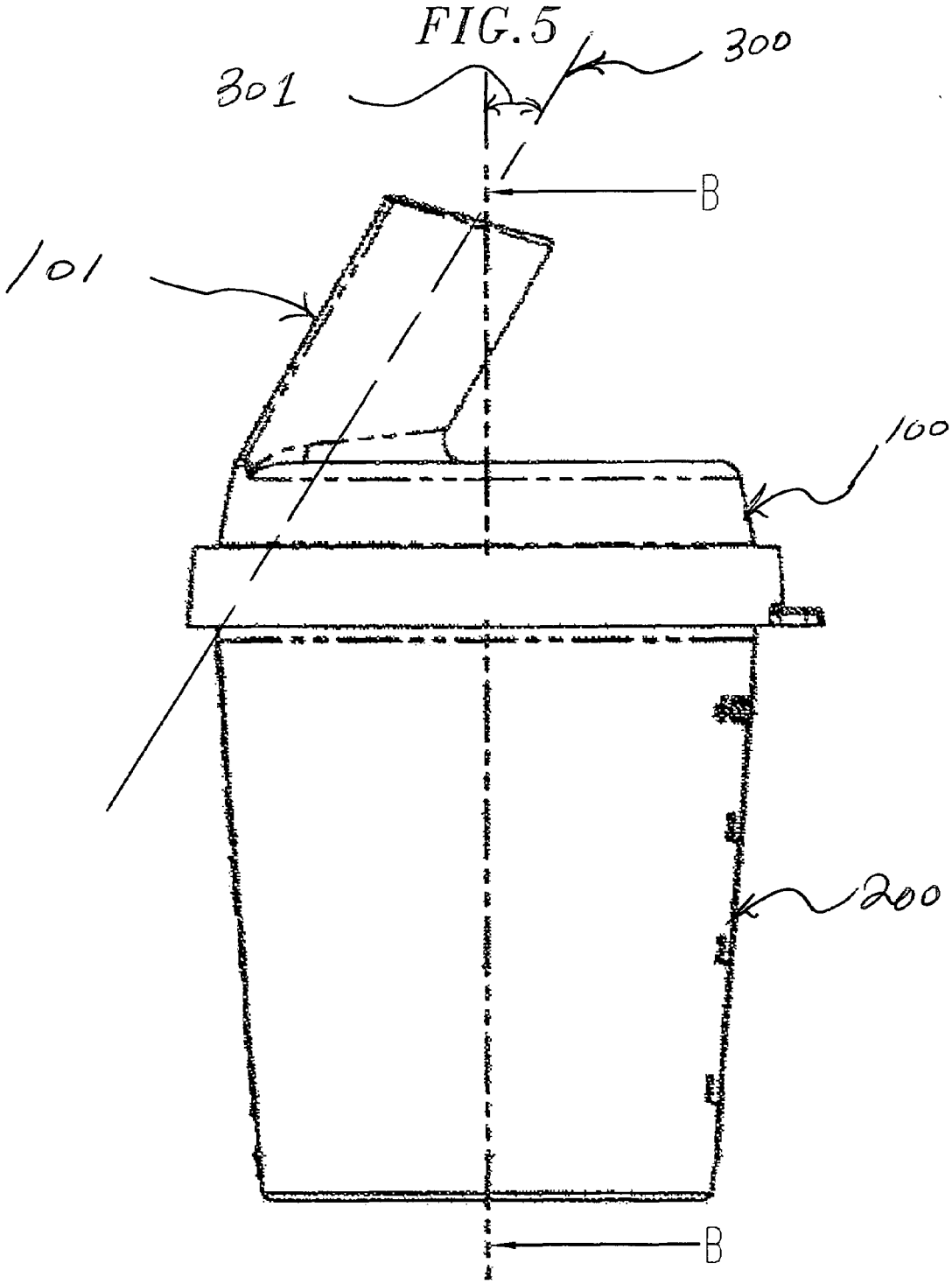
FIG. 5 is side elevation view of the improved drinking cup lid in combination with a dispensing cup.

FIG. 5 is a side elevation view of drinking cup lid 100 used in combination with cup 200, illustrating the axis that spout 101 makes with a vertical line through the center line of the cup lid assembly with the axis 300 of spout 101 offset from the vertical line by angle 301, which in the preferred embodiment is in the range of 30 to 35 degrees.

Figure 6:
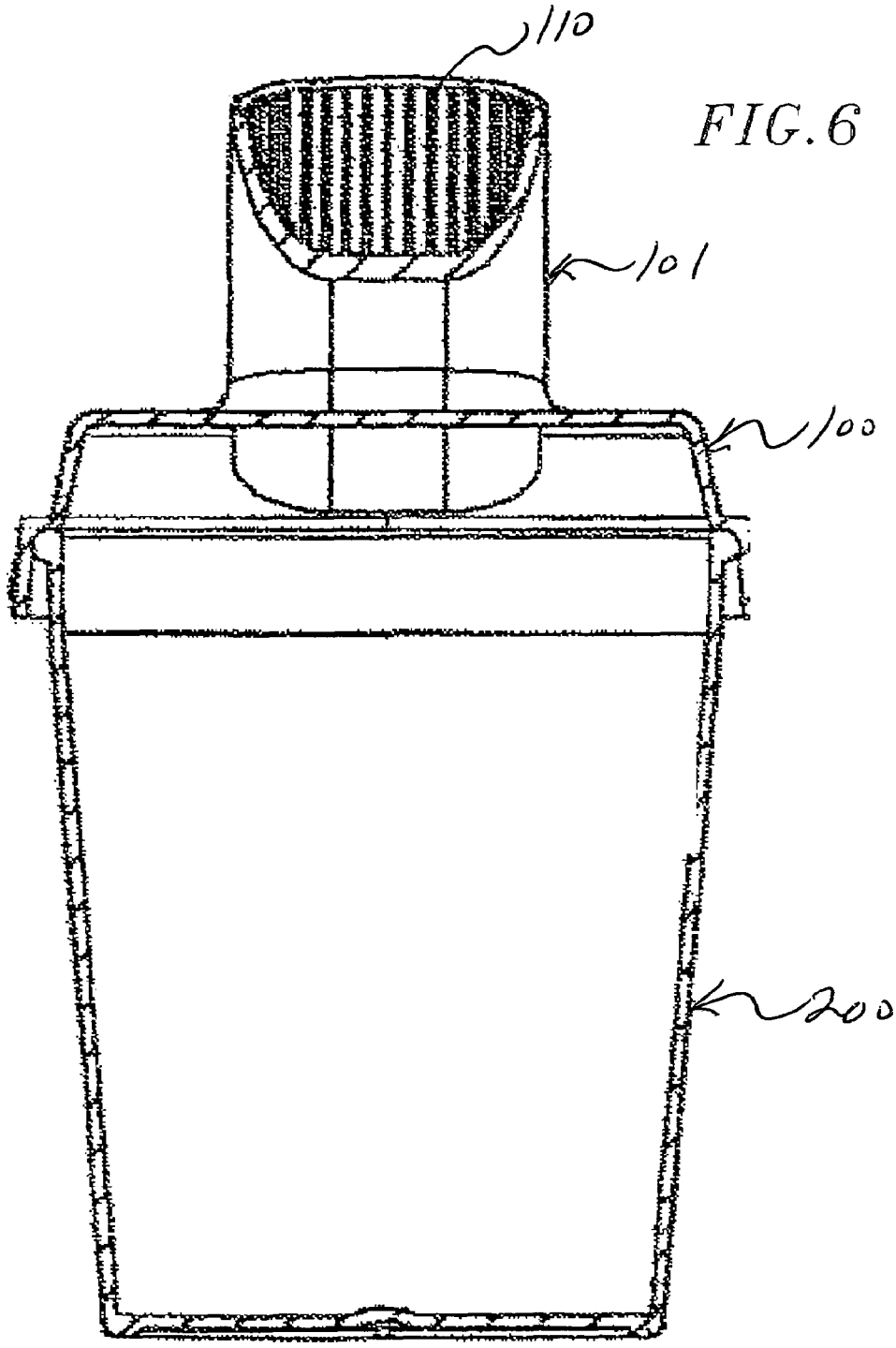
FIG. 6 is a cross section of the improved drinking cup lid used in combination with a dispensing cup through section BB.

FIG. 6 illustrates drinking cup lid 100 used in combination with cup 200, illustrating spout 101 and showing long side ribs 110.

Figure 7:
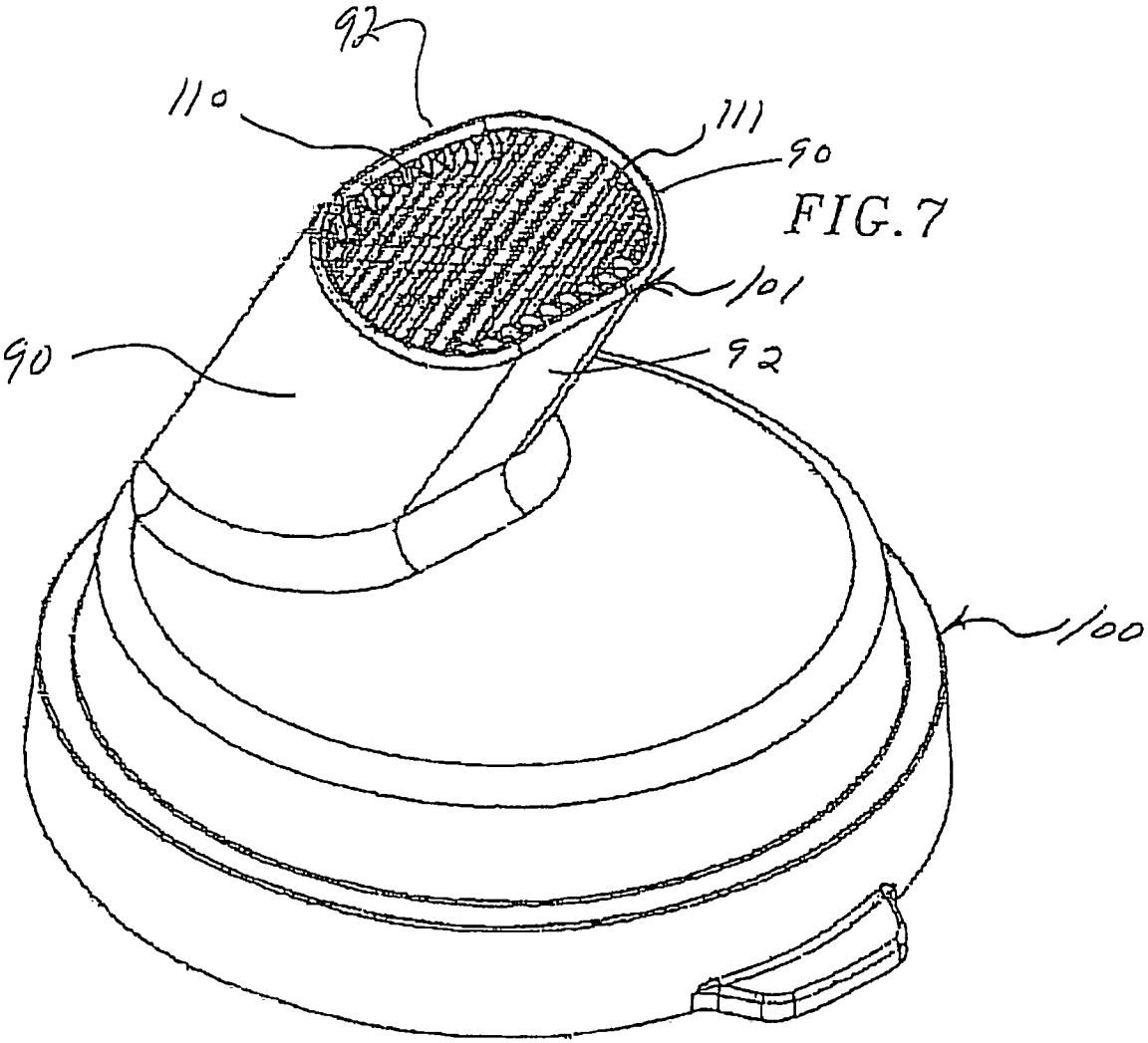
FIG. 7 is an isometric view of the improved drinking cup lid.

FIG. 7 illustrates drinking cup lid 100 in isometric view, illustrating the orientation of spout 101 and short side spout ribs 111 and long side spout ribs 110. The short side ribs 111 are disposed along the short sides 90 of the interior of the spout 101, substantially parallel to the axis 300 of the spout 101 as shown in FIG. 5. The long side ribs 110 are disposed along the long sides 92 of the interior of the spout 101, also substantially parallel to the axis 300 of the spout 101 as shown in FIG. 5. In combination the short side ribs 111 and the long side ribs 110 are configured circumferentially around the interior vertical surface of the spout.

Figure 8:
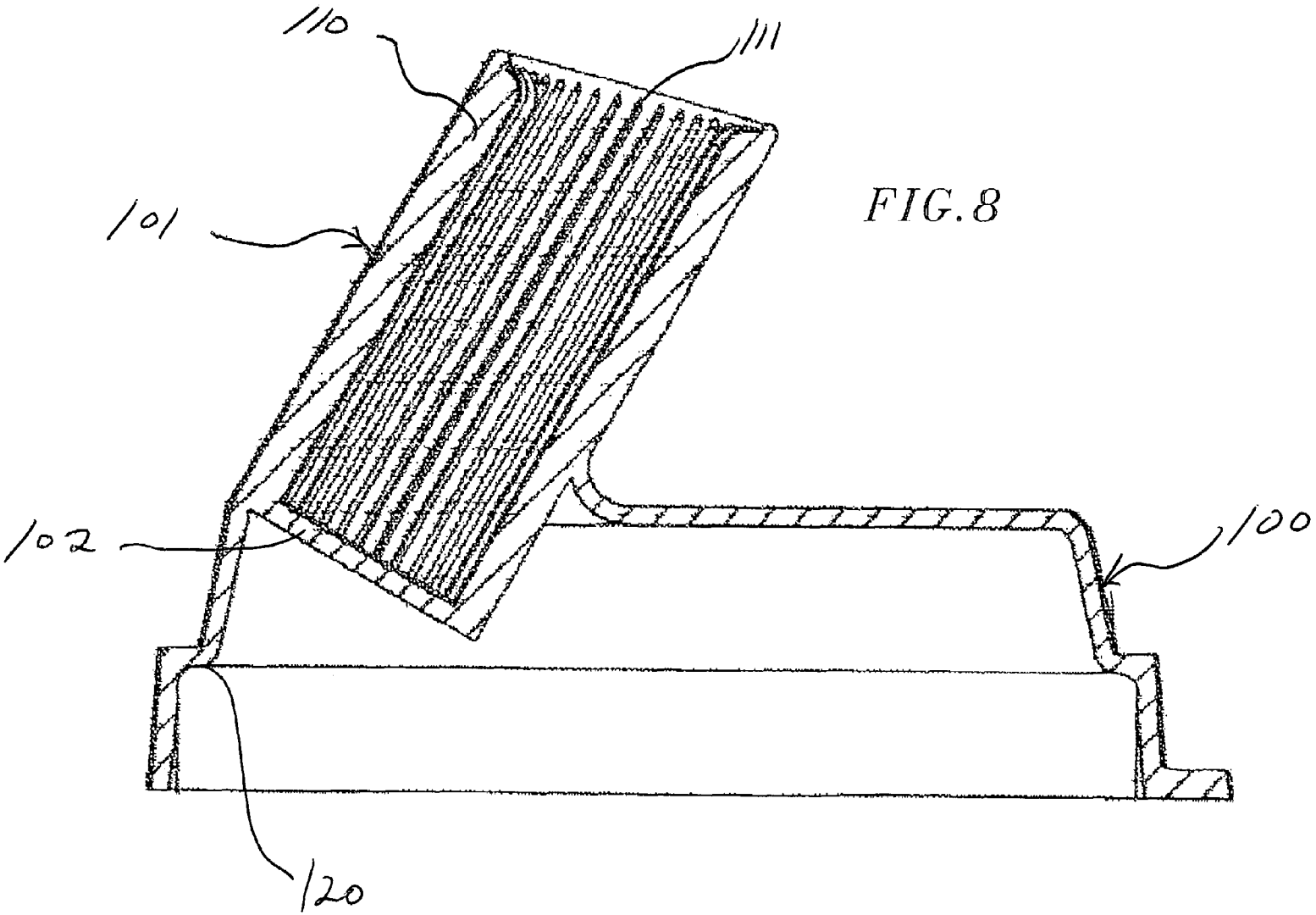
FIG. 8 is a cross section of the improved drinking cup lid through section AA as shown in FIG. 3.

FIG. 8 is an illustration of a cross-section of drinking cup lid 100 viewed along section AA from FIG. 3, illustrating base grid 102, spout 101, long side ribs 110, and short side ribs 111, and further illustrating shoulder 120. Base grid 102 is designed and configured in a plane substantially perpendicular to the axis 300 of the spout 101 as shown in FIG. 5.

Figure 9:
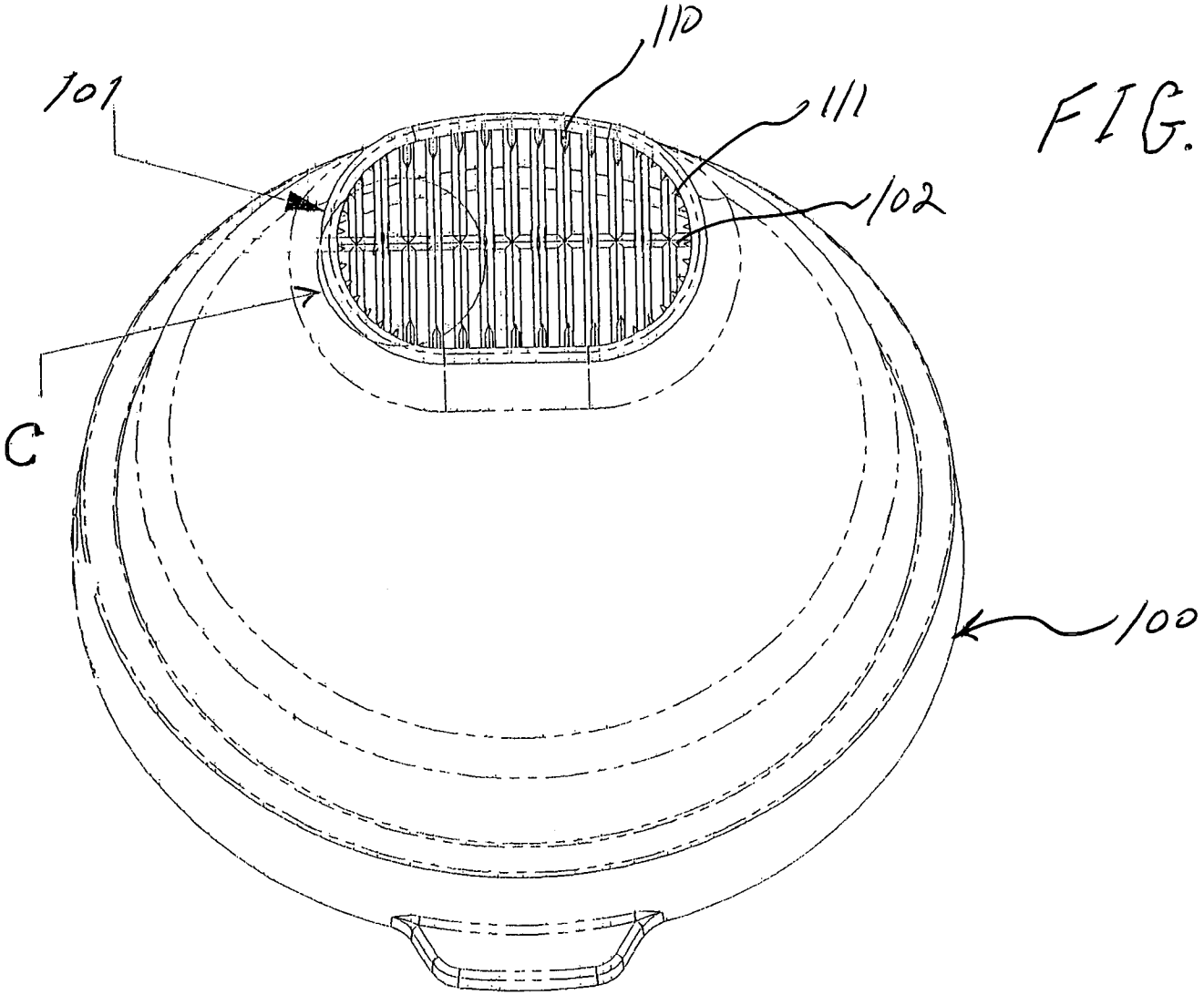
FIG. 9 is a top elevation view along axis 300 as shown in FIG. 5.

FIG. 9 is a view of drinking cup lid 100 viewed along spout axis 300 as shown in FIG. 5, vertically down axis 300 of spout 101, illustrating the orientation of long side ribs 110, short side ribs 111, and bottom grid 102.

Figure 10:
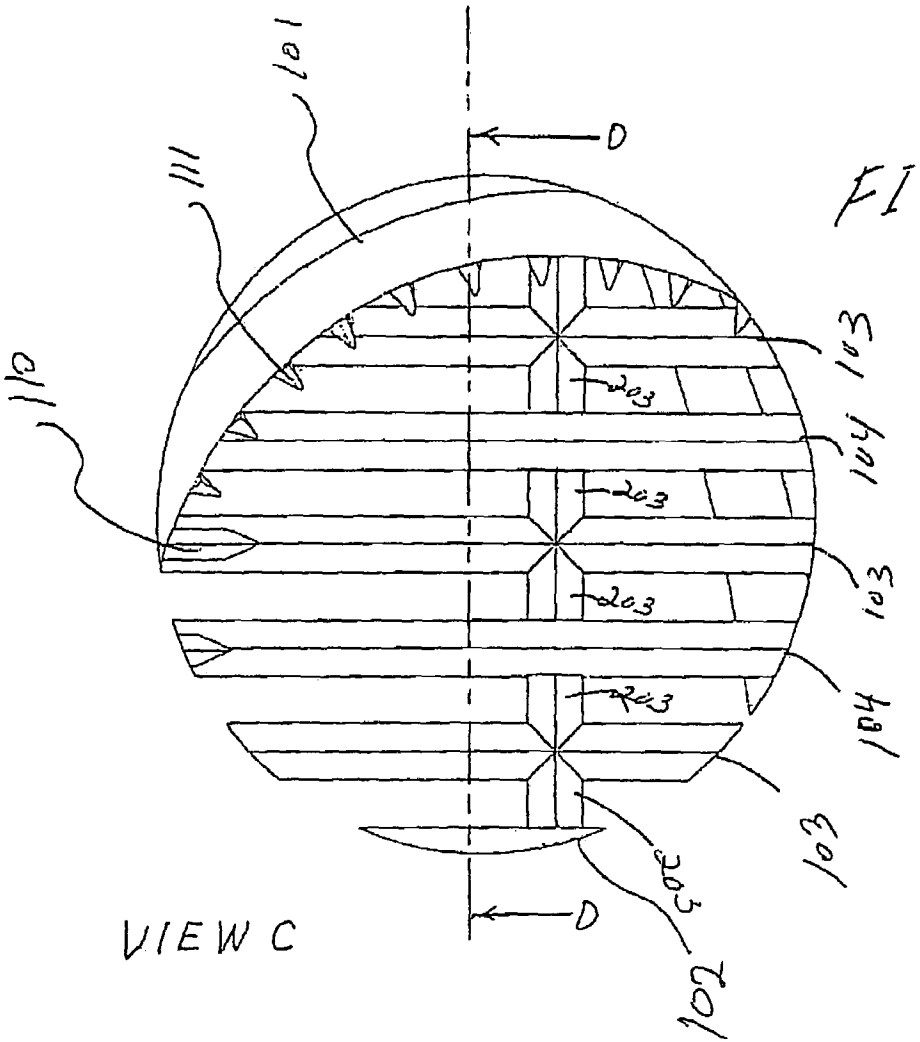
FIG. 10 is an enlarged portion of FIG. 9 shown in circular section C of the spout viewed along axis 300.

FIG. 10 is an enlarged portion of circular section C from FIG. 9, illustrating a portion of spout 101, short side ribs 111, long side ribs 110, base grid 102, low base ribs 103, and high base ribs 104. Low base ribs 103 and high base ribs 104 are designed to be of different heights, uniform along their lengths, and are configured to alternate in a pattern along base grid 102 in which each low base rib 103 is adjacent to a high base rib 104, and each high base rib 104 is adjacent to a low base rib 103, such that the low base ribs 103 and the high base ribs 104 are substantially parallel to each other. Supporting cross base rib 203 is configured to support the low base ribs 103 and the high base ribs 104 during the machining process, but does not add any functionality to the inventive features of the present invention.

Figure 11:
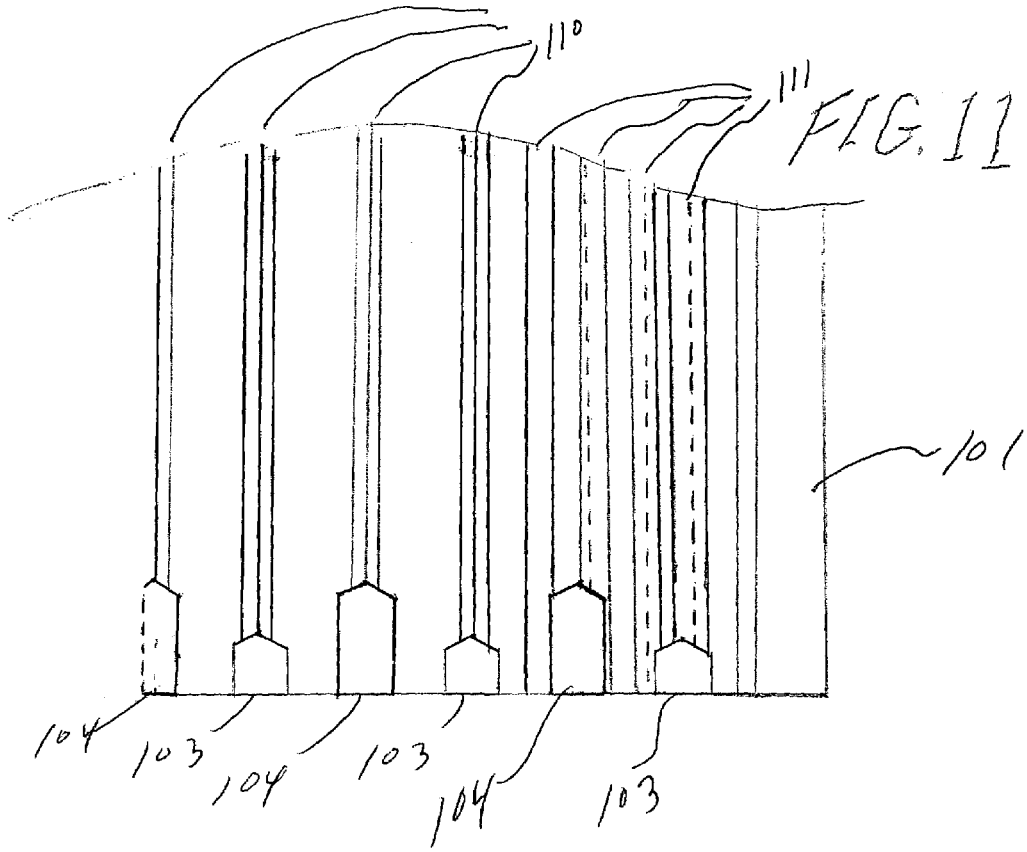
FIG. 11 is a view of the base of the spout through section D as shown in FIG. 10.

FIG. 11 illustrates a cross-section through base grid 102 along section DD in FIG. 10, which illustrates a portion of spout 101, short side ribs 111, long side ribs 110, low base ribs 103, and high base ribs 104 in the alternating pattern of base ribs 103 and 104 as well as the alignment between side ribs 110 and base ribs 103 and 104.

The present invention has been shown in various embodiments, and the terms which have been used are used as terms of description and are not to be construed as limitations or excluding any equivalents of any of the features shown and described herein. Other improvements and modifications to this invention will become readily apparent to those skilled in the art. Therefore , the scope and intent of the present invention is to be limited only by the following claims.

I claim:

1. An improved drinking cup lid for assisting in the ingestion of medication, which is comprised of a lid fully extending over a cup;

a spout attached to the lid and which is tilted toward the center line of the cup, said spout having a base grid through which liquid from the cup passes into said spout; said spout having a plurality of internal ribs along interior, vertical sides of said spout; said plurality of said internal ribs configured circumferentially around said interior, vertical sides of said spout wherein said base grid is comprised of a plurality of low base grid ribs and a plurality high base grid ribs said plurality of said low base grid ribs and said plurality of said high base grid ribs configured in an alternating pattern in said base grid for minimizing contact with the supported medication; wherein each of said plurality of said low base grid ribs has a first height, and each of said plurality of said high base grid ribs has a second height, wherein said first height of each of said plurality of said low base grid ribs is not equal to said second height of each of said plurality of said high base grid ribs;

and wherein said spout is tilted toward the center line of said lid at an angle of 30 to 35 degrees.

2. The improved drinking cup lid as described in claim 1 in which said low base grid ribs and said high base grid ribs in said base grid and said plurality of said internal ribs configured circumferentially around said interior, vertical sides of said spout have pointed tops.

3. The drinking cup lid as described in claim 2 in which said spout is shaped like a hollow tube having a substantially oval cross-section, wherein said spout has short sides and long sides.

4. The improved drinking cup lid as described in claim 3 in which said base grid is substantially perpendicular to an axis of said spout.

5. The improved drinking cup lid as described in claim 3 in which said plurality of said internal ribs configured circumferentially around said interior, vertical sides of said spout are substantially parallel with an axis of said spout.

6. The drinking cup lid as described in claim 5 in which said plurality of said internal ribs configured circumferentially around said interior, vertical sides of said spout are comprised of a plurality short side ribs configured on said short sides of said spout and a plurality of long side ribs configured on said long sides of said spout, wherein said plurality of said short side ribs and said plurality of said long side ribs have different heights.

* * * * *